US010333251B2

(12) United States Patent
Miyamura et al.

(10) Patent No.: US 10,333,251 B2
(45) Date of Patent: Jun. 25, 2019

(54) ELECTRICAL CONNECTION DEVICE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/780,252

(22) PCT Filed: Nov. 22, 2016

(86) PCT No.: PCT/JP2016/084663
§ 371 (c)(1),
(2) Date: May 31, 2018

(87) PCT Pub. No.: WO2017/094570
PCT Pub. Date: Jun. 8, 2017

(65) Prior Publication Data

US 2018/0358747 A1 Dec. 13, 2018

(30) Foreign Application Priority Data

Dec. 3, 2015 (JP) ..... 2015-236502

(51) Int. Cl.
*H01R 13/631* (2006.01)

(52) U.S. Cl.
CPC ..... *H01R 13/631* (2013.01)

(58) Field of Classification Search
CPC ..... H01R 13/631; H01R 13/629; H01R 13/62933; H01R 13/73; H01R 13/62911; H01R 13/62983
(Continued)

(56) References Cited

U.S. PATENT DOCUMENTS 3,577,116 A * 5/1971 Baumanis ..... H01R 33/09 439/542
5,575,676 A 11/1996 Tsukakoshi et al.
(Continued)

FOREIGN PATENT DOCUMENTS

| | | |
|---|---|---|
| JP | 2-182586 | 7/1990 |
| JP | 7-240255 | 9/1995 |
| JP | 2005-190806 | 7/2005 |

OTHER PUBLICATIONS

International Search Report dated Feb. 14, 2017.

*Primary Examiner* — Gary F Paumen
(74) *Attorney, Agent, or Firm* — Gerald E. Hespos; Michael J. Porco; Matthew T. Hespos

(57) ABSTRACT

An electrical connection device includes a first connector (10) to be connected to first wiring materials (W1) in a first member (M1) and fixed to the first member (M1), and a second connector (20) to be connected to second wiring materials (W2) in a second member (M2) and mounted on the second member (M2). A connector holding member (30) is linked to the second member (M2) and is configured to hold the second connector (20) releasably. A connecting operating member (40) is held in the first connector (10) or the second connector (20). The connecting operating member (40) connects the first and second connectors (10, 20) in a connecting direction and separates the second connector (20) from the connector holding member (30) by being
(Continued)

operated in an operating direction intersecting the connecting direction in a state where the first and second connectors (10, 20) face each other.

5 Claims, 9 Drawing Sheets

(58) Field of Classification Search
USPC ..... 439/347, 310, 574, 575, 571, 567
See application file for complete search history.

(56) References Cited

U.S. PATENT DOCUMENTS 5,892,659 A * 4/1999 Cooper ..... H05K 7/12 174/482
6,699,070 B1 * 3/2004 Wu ..... H01R 12/7058 439/572
7,806,702 B2 * 10/2010 Aihara ..... H01R 12/7011 439/570
8,007,298 B2 * 8/2011 Komiyama ..... H01R 13/4361 439/157
8,651,883 B2 * 2/2014 Becavin ..... H01R 13/6395 439/157
8,992,240 B2 * 3/2015 Shiga ..... H01R 13/62911 439/157

* cited by examiner

ELECTRICAL CONNECTION DEVICE

BACKGROUND

Field of the Invention

The invention relates to an electrical connection device for electrically connecting members coupled to each other to be relatively rotatable.

Description of the Related Art

Devices provided with connectors that are connectable to each other are used widely for electrically connecting circuits. Each connector includes a connector terminal to be connected to a predetermined circuit via a wire or the like and a connector housing for holding the connector terminal. The circuits connected to the respective connectors are connected electrically by connecting the connector terminals of the respective connectors.

Each connector is used by being mounted at a suitable location of a vehicle or the like via a suitable mounting member. For example, Japanese Unexamined Patent Publication No. 2005-190806 that connectors of an electrical connection device are mounted on a vehicle body via fixing brackets.

Members on which the connectors are mounted include members to be coupled to each other and to be relatively rotatable within a predetermined range such as on: a vehicle body and a door, a vehicle body and a door mirror, and a steering shaft and a member for rotatably supporting the steering shaft. A wiring material often is routed in two members that are planned to rotate relative to one another, and the connectors are connected by connecting the connectors to the respective wiring materials. In this situation, one connector has to be separated from the member on which this connector is mounted, and has to be connected to the other connector to enable relative rotation regardless of the connector connection. Such operations of separating and connecting connectors are both cumbersome and have to be performed manually. This impedes an improvement of working efficiency.

The invention aims to provide an electrical connection device capable of efficiently electrically connecting members to be coupled to each other to be relatively rotatable.

SUMMARY

The invention is directed to an electrical connection device for establishing electrical connection between a first wiring material wired in a first member and a second wiring, material wired in a second member to be coupled to the first member in a coupling direction along a predetermined rotation center axis and to be relatively rotatable about the rotation center axis. The electrical connection device includes a first connector to be connected to the first wiring material and fixed to the first member. The electrical connection device also includes a second connector to be connected to the second wiring material and mounted on the first member and configured to form the electrical connection by being connected to the first connector in a specific connecting direction. A connector holding member is linked to the second member and is configured to hold the second connector at a position where the first and second connectors are capable of facing each other in the connecting direction with the first and second members coupled. The connector holding member holds the second connector in such a manner as to allow the second connector to be separated from the connector holding member in the connecting direction upon application of an external force to the second connector in the connecting direction. The electrical connection device further includes a connecting operating member to be held in a holding connector selected from the first and second connectors and is relatively movable in an operating direction intersecting the connecting direction. The connecting operating member includes a connector operating portion that is configured to connect the first and second connectors to each other by pulling an operated connector on a side opposite to the holding connector toward the holding connector along the connecting direction. The connector operating portion further is configured to separate the second connector from the connector holding member in the connecting direction by being relatively moved in the operating direction with respect to the holding connector in a state where the first and second members are coupled and the first and second connectors are facing each other in the connecting direction.

Here, that "the first and second connectors are facing each other in the connecting direction" means both a state where the first and second connectors are facing each other at a distance in the connecting direction and a state where the first and second connectors are in a temporarily connected state to partially overlap each other in the connecting direction.

DETAILED DESCRIPTION

Figure 1:
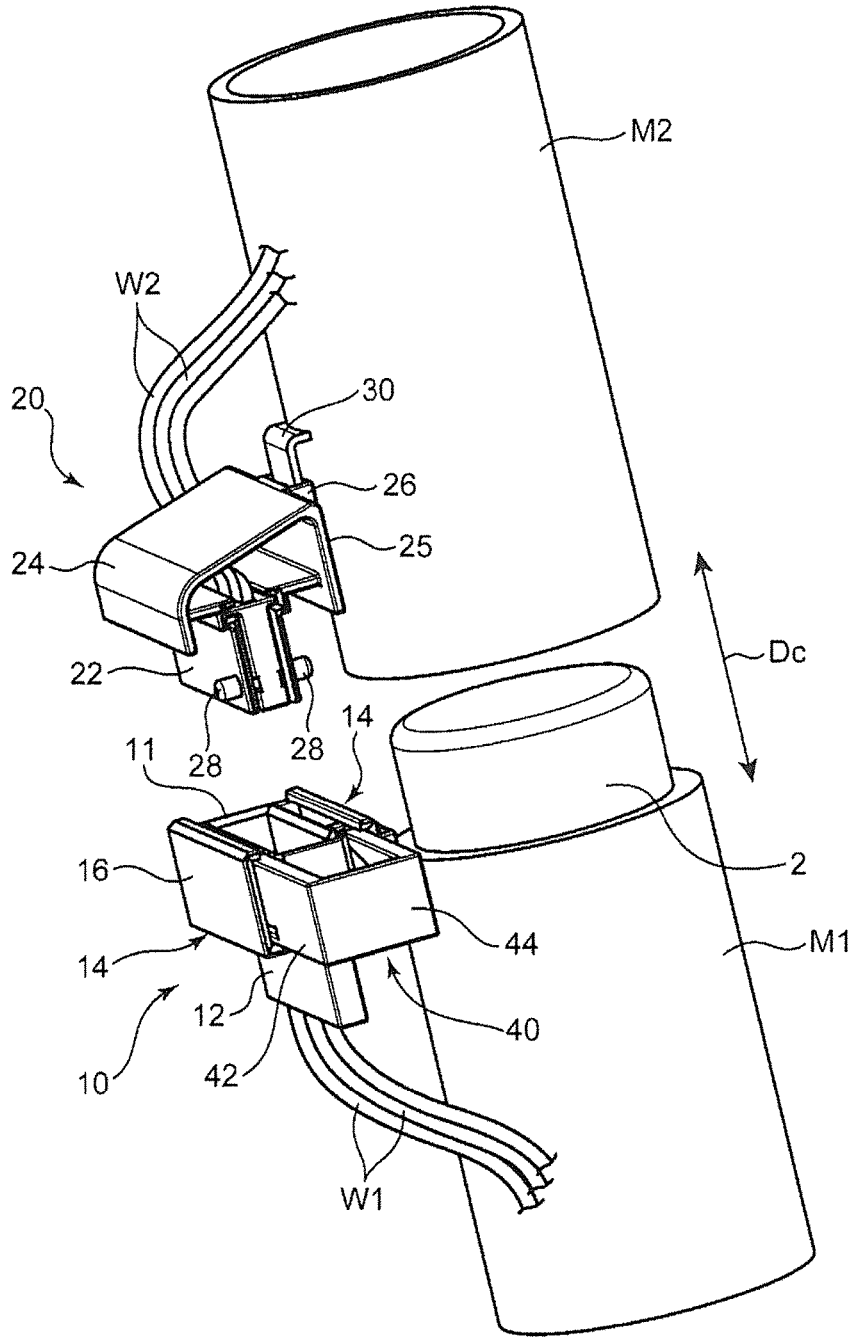
FIG. 1 is a perspective view of a first member, a second member and an electrical connection device arranged around the first and second members according to an embodiment of the present invention in a state before the first and second members are coupled.

A preferred embodiment of the present invention is described with reference to the drawings.

An electrical connection device according to this embodiment is for electrically connecting first wiring materials W1 wired in a first member M1 and second wiring materials W2 wired in a second member M2 that is to be coupled to the first member M1 to be relatively rotatable within a predetermined range. The electrical connection device includes a first connector 10, a second connector 20, a connector holding member 30 and a connecting operating member 40.

In this embodiment, the first member M1 is in the form of a cylinder or hollow cylinder extending in a vertical direction, and an upper end part thereof constitutes a fit-in portion 2 having a cylindrical outer peripheral surface with a diameter smaller than other parts. The second member M2 is in the form of a cylinder or hollow cylinder having a lower end into which the fit-in portion 2 is fittable. By fitting the fit-in portion 2 into the second member M2, the first and second members M1, M2 are coupled in a coupling direction (direction indicated by arrows Dc in FIG. 1) along a rotation center axis equivalent to center axes of the first and second members M1, M2 to be relatively rotatable about the rotation center axis.

In this embodiment, the first member M1 is arranged on a lower side and the second member M2 is arranged on an upper side, but the arrangement of first and second members according to the invention is not limited. Further, the shapes of the first and second members also are not limited.

The first connector 10 is connected to ends of the first wiring materials W1. The first wiring materials W1 are routed, for example, to extend along the outer peripheral surface of the first member M1.

The first connector 10 includes unillustrated connector terminals (male connector terminals in this embodiment) and a connector housing 12. The connector terminals are connected respectively to the ends of the first wiring materials W1. The connector housing 12 holds rear parts of the respective connector terminals while leaving tip parts (male electrical contact portions) thereof. The connector housing 12 includes a receptacle 11 surrounding the tip parts of the respective connector terminals and fixed at a predetermined location of the first member M1, i.e. on the outer peripheral surface near the fit-in portion 2 in this embodiment, with the receptacle 11 facing up toward the second member M2. The first connector 10 may be fixed to the first member M1 by directly holding both in contact or by coupling the first connector 10 to the first member M1 via a bracket or the like.

The first connector 10 according to this embodiment functions as a holding connector for holding the connecting operating member 40. Specifically, the first connector 10 includes the connector housing 12 and two connecting operating member holding portions 14 integrally molded to the connector housing 12. The connecting operating member 40 and the connecting operating member holding portions 14 are described in detail later.

The second connector 20 is connected to ends of the second wiring materials W2. The second wiring materials W2 are routed, for example, to extend along the outer peripheral surface of the second member M2, in a manner similar to the first wiring materials W1.

The second connector 20 includes unillustrated connector terminals (female connector terminals in this embodiment), a connector housing 22, a cover 24 and a held portion 26.

The connector terminals are connected respectively to the ends of the first wiring materials W2. The connector housing 22 holds the connector terminals such that female electrical contact portions on tips of the respective connector terminals are open to the outside. The connector housing 22 has an outer shape to be able to fit into the receptacle 11 of the connector housing 12. As the connector housing 12 is fit, the connector terminals held in the connector housing 12 and those held in the connector housing 22 are connected to each other, thereby electrically connecting the first wiring materials W1 and the second wiring materials W2. That is, the first connector 10 and the second connector are connected to each other along a connecting direction parallel to a fitting direction of the connector housing 22 into the receptacle 11, thereby enabling the first and second wiring materials W1, W2 to be connected electrically. In this embodiment, the connecting direction is parallel to the vertical direction, i.e. the rotation center axis.

The connector housing 22 is mounted on the second member M2 via the connector holding member 30 at a mounting position where the connector housings 12, 22 can face each other in the connecting direction when the first and second members M1, M2 are coupled, specifically at a position on the outer peripheral surface of a lower end part of the second member M2.

Figure 3:
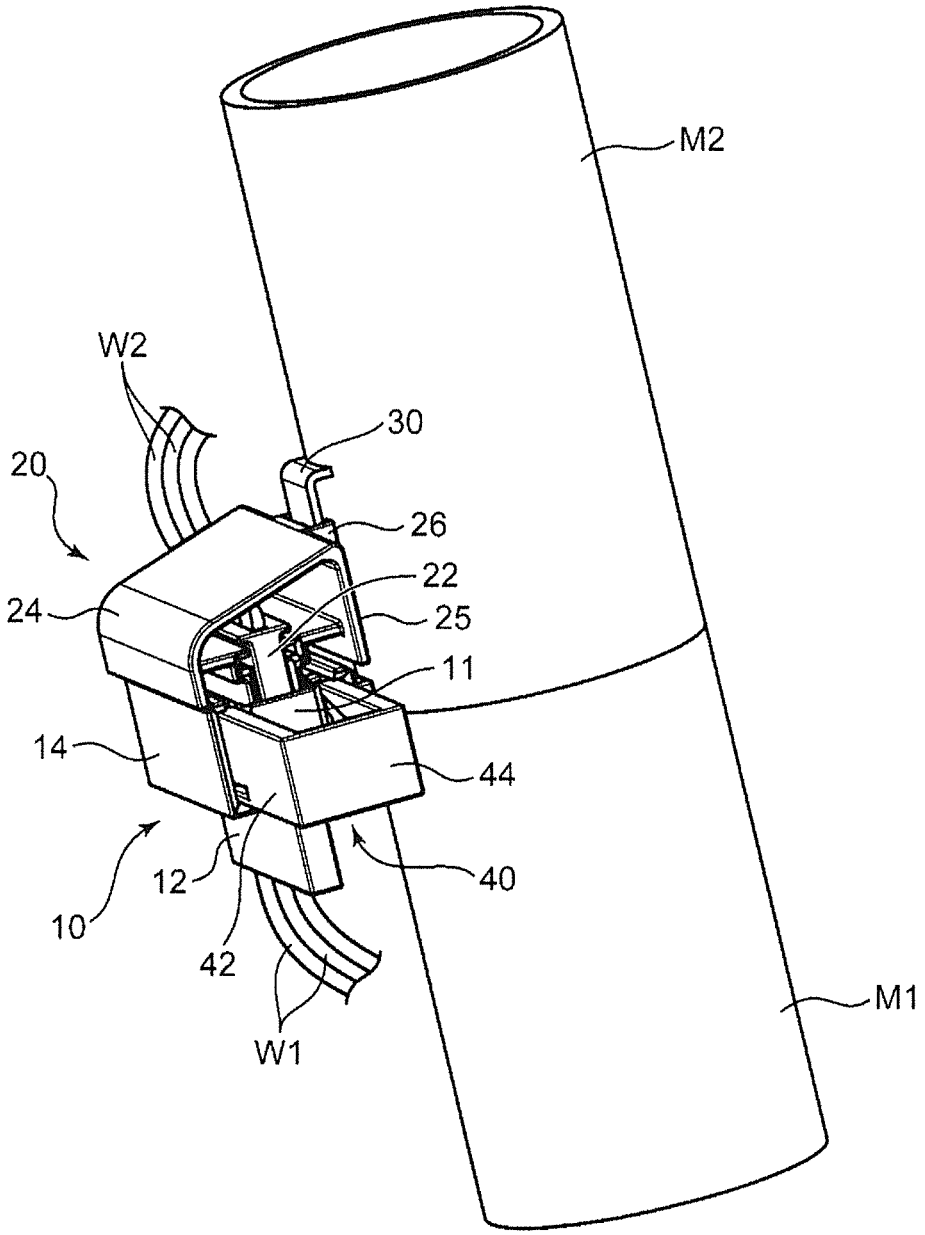
FIG. 3 is a perspective view showing a state where the first and second members are coupled to each other and a first connector and the second connector are facing each other.
Figure 4:
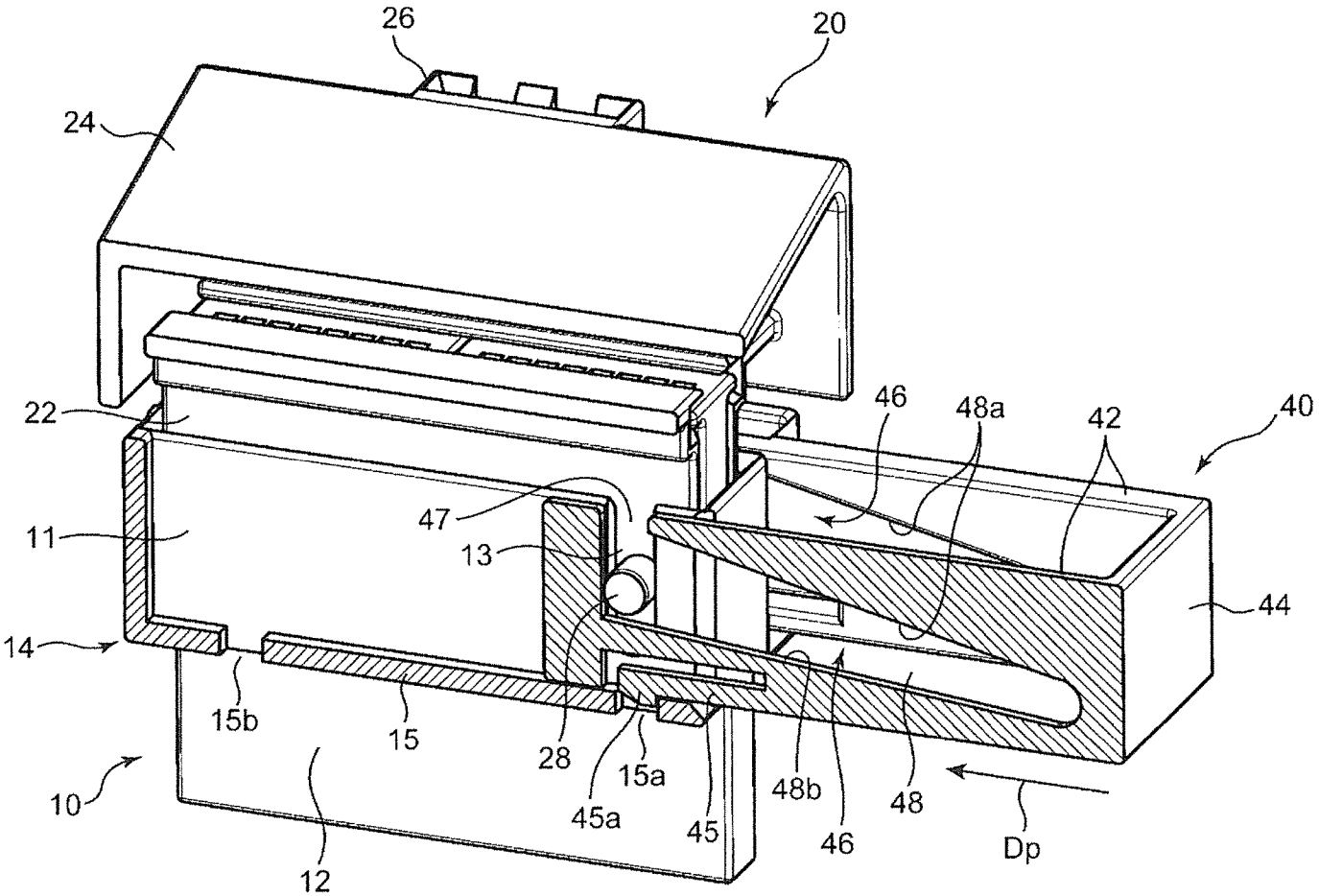
FIG. 4 is a perspective view partly in section showing a relative positional relationship of operating surfaces of a connecting operating member and operated portions of the second connector in a state shown in FIG. 3.

That "the first and second connectors face each other in the connecting direction" mentioned herein means both a state where the first and second connectors are facing each other at a distance in the connecting direction, as described above, and a temporarily connected state where the first and second connectors partially overlap each other in the connecting direction. Similarly, "to face each other" means a state where the upper end of the receptacle 11 of the first connector 10 overlaps with the lower end of the connector housing 22 of the second connector 20, i.e. the temporarily connected state where the connector housing 22 is fit lightly in the receptacle 11, as shown in FIGS. 3 and 4.

The cover 24 is shaped to cover the connector housing 22 from above. The cover 24 has a back surface 25 facing the outer peripheral surface of the second member M2, and the held portion 26 is formed on this back surface 25. The held portion 26 is to be held by the connector holding member 30.

The connector holding member 30 functions to hold the held portion 26 of the second connector 20 to locate the second connector 20 at the mounting position by being fixed to the second member M2 and to allow the separation of the held portion 26 from the connector holding member 30 in the connecting direction upon application of an external force in the connecting direction, i.e. a downward external force, to the second connector 20.

Figure 2:
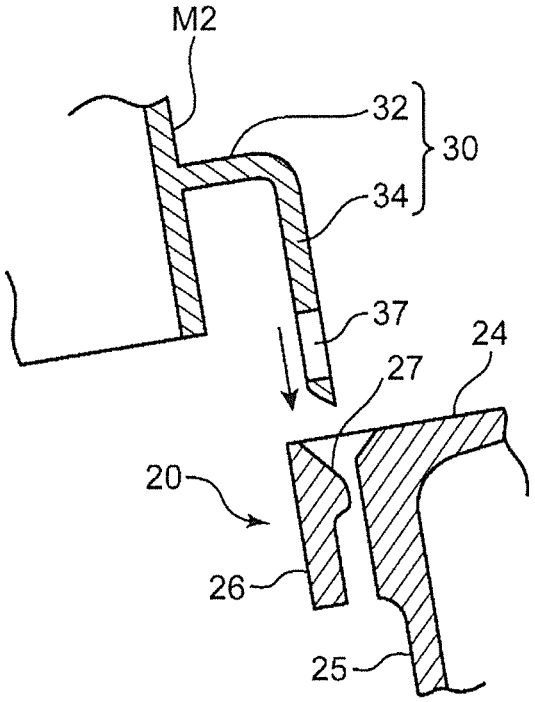
FIG. 2 is a side view in section showing a structure for engaging a connector holding member and a second connector in the electrical connection device.

The connector holding member 30 according to this embodiment is in the form of a tongue piece projecting down from the outer peripheral surface of the second member M2. Specifically, as shown in FIG. 2, the connector holding member 30 includes a base 32 projecting out in a radial direction from the outer peripheral surface of the second member M2 and a holding portion 34 extending down from an outer side end of the base 32, and a locking hole 37 penetrates through a lower end part of the holding portion 34 in the radial direction.

Note that the connector holding member according to the invention may be formed independently of the second member and joined to the second member by welding or other means or may be formed integrally to the second member, i.e. constitute a single member together with the second member.

On the other hand, the held portion 26 has a box shape and, together with the back surface 25 of the cover 24, defines an insertion space. The insertion space is open upward and downward and is shaped to allow the insertion of the holding portion 34 into the insertion space through an upper end of the insertion space. The held portion 26 includes a locked projection 27 partially projecting into the insertion space, and the held portion 26 is held in the holding portion 34 by fitting the locked projection 27 into the locking hole 37 of the holding portion 34 inserted into the insertion space. Further, by applying a downward external force of a certain magnitude or larger to the second connector 20 including the held portion 26 from this state, the locked projection 27 is separated from the locking hole 37 in a downward direction, which is a separating direction, thereby enabling the held portion 26 to be detached from the holding portion 34.

The connecting operating member 40 is held by the connecting operating member holding portions 14 of the first connector 10 to be relatively movable in an operating direction. The operating direction in this embodiment is the horizontal direction perpendicular to the connecting direction, as indicated by an arrow Dp in FIG. 4. The operating direction also is perpendicular to radial directions of the first and second members M1, M2 in this embodiment and intersects the connecting direction (vertical direction in this embodiment). The connecting operating member 40 includes a connector operating portion that functions to pull the operated connector (second connector 20 in this embodiment) on a side opposite to the holding connector toward the first connector 10 (lower side in this embodiment) along the connecting direction to connect the first and second connectors to each other. The connector operating portion also can separate the second connector 20 from the connector holding member 30 in the separating direction by being operated to move the connecting operating member 40 in the operating direction with respect to the first connector 10 in a state where the first and second connectors 10, 20 are facing each other in the connecting direction, as described above (in this embodiment, in the temporarily connected state shown in FIGS. 3 and 4).

The connecting operating member 40 according to this embodiment integrally includes two side walls 42 and an end wall 44. The side walls 42 are juxtaposed in an operating width direction (depth direction in FIG. 4), which is a horizontal direction perpendicular to the operating direction, while rising up and parallel with each other. The end wall connects end parts of the side walls 42 on one side in the operating direction (rear end parts in the operating direction; right end parts in FIG. 4) in the operating width direction. The connecting operating member 40 is mounted on the connector housing 12 to sandwich the receptacle 11 of the first connector 10 from both sides in a juxtaposing direction and is relatively movable in the operating direction (lateral direction in FIG. 4) with respect to the connector housing 12 in this mounted state.

The two connecting operating member holding portions 14 are shaped to embrace the respective side walls 42 at positions outward of the side walls 42. Specifically, each connecting operating member holding portion 14 integrally includes a bottom wall 15 and an outer side wall 16. The bottom wall 15 supports the corresponding side wall 42 at a position below this side wall 42. The outer side wall 16 extends up from an outer end of the bottom wall 15 to sandwich the side wall 42 between an outer side surface of the receptacle 11 and the outer side wall 16. Specifically, the connecting operating member holding portion 14 holds the side wall 42 of the connecting operating member 40 at the position outward of the side wall 42 while allowing, the side wall 42 of the connecting operating member 40 to slide in the operating direction along the outer side surface of the receptacle 11.

Figure 6:
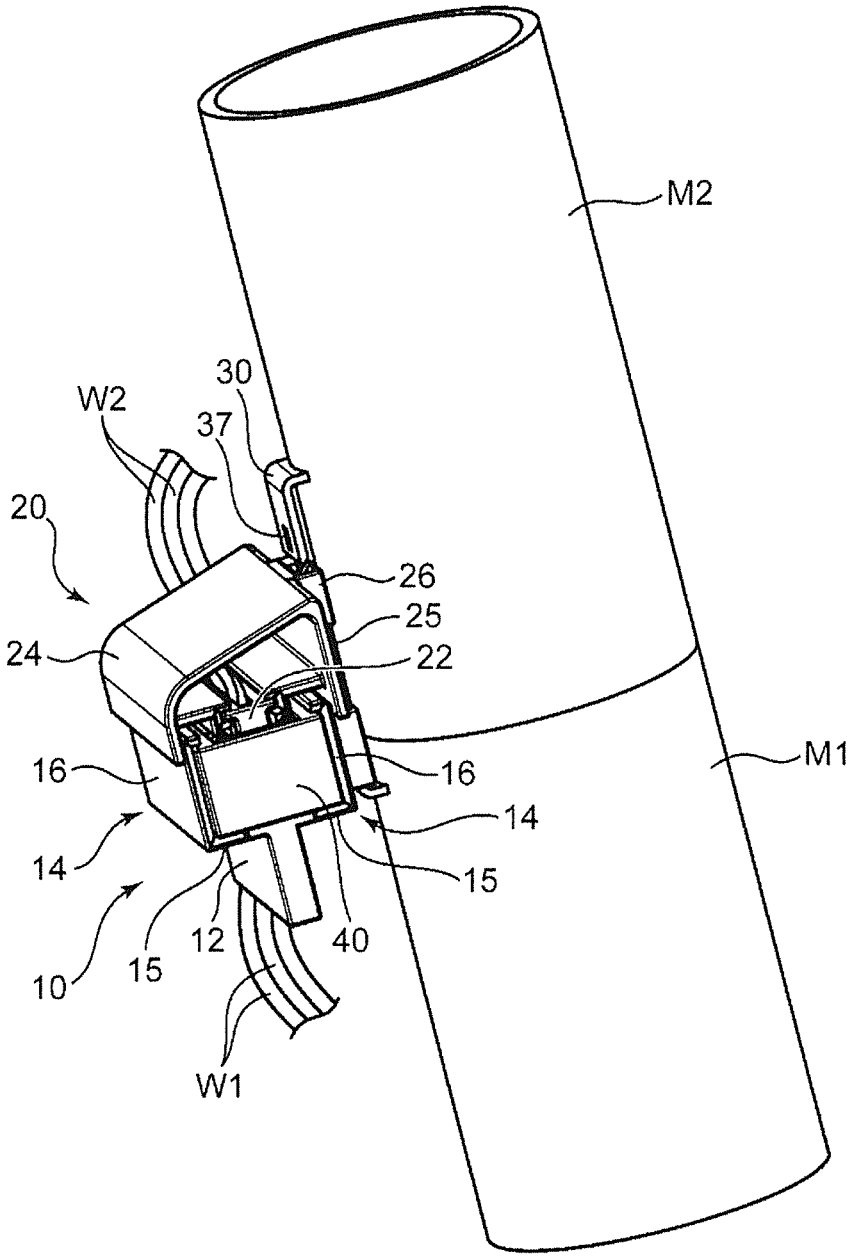
FIG. 6 is a perspective view showing a state where the connecting operating member is further operated from the state shown in FIG. 5 to completely connect the first and second connectors.
Figure 7:
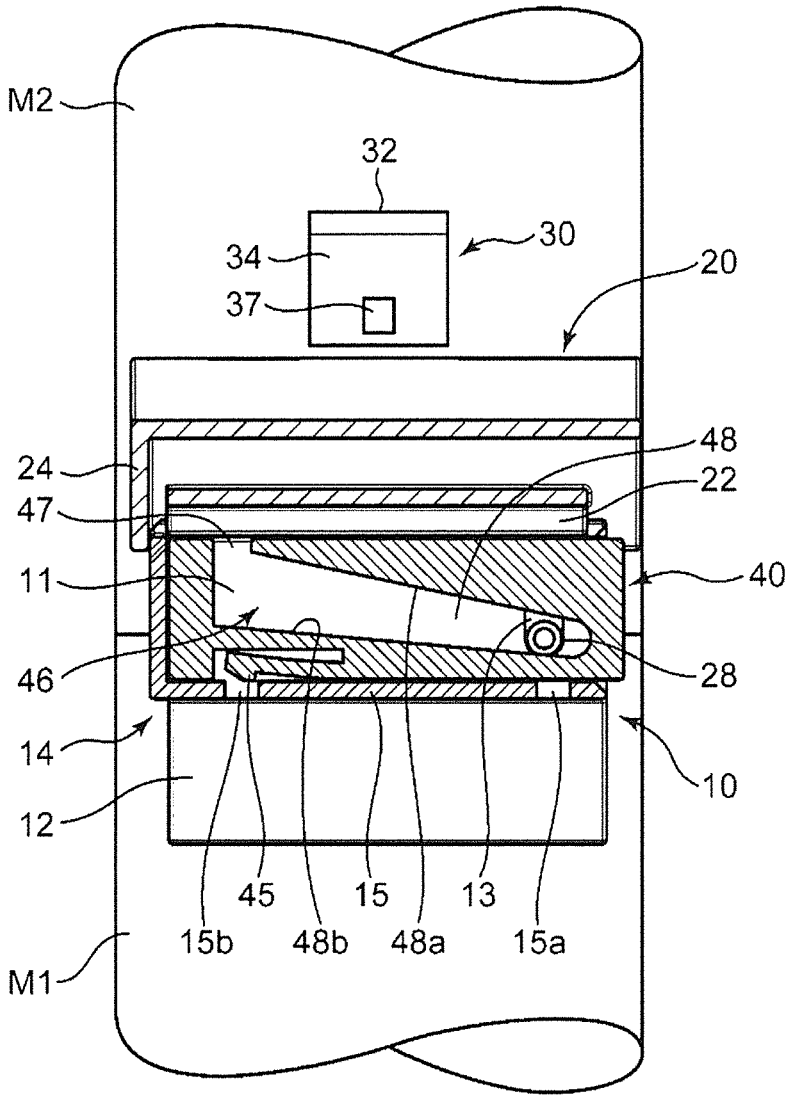
FIG. 7 is a front view in section showing the state shown in FIG. 6.

Further, the connecting operating member holding portions 14 function to lock the connecting, operating member 40 detachably at an operation start position, as shown in FIGS. 3 and 4, and at an operation end position, as shown in FIGS. 6 and 7. The operation end position is downstream of the operation start position in the operating direction; which is the left position in FIG. 4. In other words, the connecting operating member 40 can be locked detachably at each of the operation start position and the operation end position.

Specifically, an upwardly deflecting piece 45 is formed on a lower end of a front part (left part in FIG. 4) of the side wall 42 in the operating direction, and a locked projection 45*a* projects down on a free end part of this deflecting piece 45. In contrast, a first locking hole 15*a* and a second locking hole 15*b* are formed in the bottom wall 15 of the connecting operating member holding portion 14 for receiving the locking projection 45*a* fit therein when the connecting operating member 40 is at each of the operation start position and the operation end position.

The second connector 20, which is the operated connector, includes two operated portions 28. The operated portions 28 project out in the operating width direction from side surfaces of the connector housing 22 that face in the operating width direction (horizontal direction perpendicular to the operating direction; depth direction in FIG. 4). The operated portions 28 are set at positions near the lower end of the connector housing 22 and near the end part 44 of the connecting operating member 40 held by the connecting operating member holding portions 14 (position near the right end in FIG. 4).

The receptacle 11 of the connector housing 12 of the first connector 10 is formed with fitting grooves 13 corresponding to the respective operated portions 28. Each fitting groove 13 is shaped to receive the operated portion 28 fit from above when the connector housing 22 of the second connector 20 is fit into the receptacle 11 and extends down from the upper end of the receptacle 11. The operated portions 28 are fit into the fitting grooves 13 to enable the connector housing 22 to be fit into the receptacle 11 while avoiding interference between the operated portions 28 and the receptacle 11. Further, a projecting distance of each operated portion 28 is set such that an end part of the operated portion 28 projects farther out than the outer side surface of the receptacle 11 with the operated portion 28 fit in the fitting groove 13.

The connector operating portion of the connecting operating member 40 contacts the operated portions 28 as the connecting operating member 40 is moved in the operating direction to forcibly displace (in this embodiment, push down) the operated portions 28.

Specifically, an operating groove 46 is formed in the inner side surface of each side wall 42 of the connecting operating member 40 and is recessed farther out than other inner side surfaces. The operating groove 46 receives an end part (end part projecting further outward than the receptacle 11) of the operated portion 28, and an operating surface of the connector operating portion is formed by the recess of this operating groove 46.

The operating groove 46 includes an insertion opening 47 and a body groove 48.

The insertion opening 47 is a position to receive the operated portion 28 inserted from above with the connecting operating member 40 located at the operation start position. Specifically, the insertion opening 47 is at a position near a front end (left end in FIG. 4) of each side wall 42 in the operating direction and is open up on the upper end of the side wall 42.

The body groove 48 extends in a direction (right in FIG. 4) opposite to the operating direction from a start end (front end in the operating direction; left end in FIG. 4) located below the insertion opening 47 and gradually narrows in the vertical direction toward a terminal end (rear end in the operating direction; right end in FIG. 4). A vertical width of the start end of the body groove 48 is larger than a diameter of the operating portion 28.

Upper and lower ends of the body groove 48 are defined respectively by an upper end surface 48*a* and a lower end surface 48*b*. The upper and lower end surfaces 48*a*, 48*b* are inclined to be lower toward the rear end (right end in FIG. 4) of the side wall 42 in the operating direction (with respect to the operating direction). However, an inclination angle of the upper end surface 48*a* is larger than that of the lower end surface 48*b*, and the vertical width of the body groove 48 becomes smaller toward the rear end in the operating direction by this difference in inclination angle.

The operating surface of the connecting operating member 40 is formed by the upper end surface 48*a* of the body groove 48. Specifically, the upper end surface 48*a* comes into contact with the operated portion 28 in the process of operating the connecting operating member 40 in the operating direction from the operation start position (FIG. 5) and pushes down the operated portion 28 and further the second connector 20 including the operated portion 28 by further continuing the operation of the connecting operating member 40 from the operation start position. The position and inclination angle of the upper end surface 48*a* are set such that the upper end surface 48*a* functions as just described.

Next, how to use this electrical connection device and how this electrical connection device functions are described.

Installation of First and Second Connectors 10, 20

Prior to electrical connection, the first and second connectors 10, 20 are installed respectively on the first and second members M1, M2.

For the first member the first wiring materials W1 are wired around the first member M1 with the first connector 10 connected to the ends of the first wiring materials W1. Further, the first connector 10 is fixed at a proper fixed position as shown in FIG. 1, i.e. at a position near the upper end of the first member M1 on the outer peripheral surface of the first member M1.

For the second member M2, the second wiring materials W2 are wired around the second member M2 with the second connector 20 connected to the ends of the second wiring materials W2. Further, the second connector 20 is fixed at a proper fixed position, as shown in FIG. 1 and the like, i.e. at a position near the lower end of the second member M2 on the outer peripheral surface of the second member M2. Specifically, the second connector 20 is so set that the holding portion 34 is inserted into the insertion space inside the held portion 26 of the second connector 20 in a state where the base 32 of the connector holding member 30 projects from the outer peripheral surface of the second member M2 and the holding portion 34 extends down from the outer side end of the base 32, and the held portion 26 is held in the holding portion 34 by fitting the operated projection 27 of the held portion 26 into the locking hole 37 of the holding portion 34.

Note that extra lengths are given to the second wiring materials W2 to allow the second member M2 to rotate with respect to the first member M1 within a predetermined range regardless of the connection when the connection of the first and second connectors 10, 20 is completed as described later.

Further, in this preliminary step, the connecting operating member 40 is held at the operation start position shown in FIGS. 1, 3 and 4 with respect to the first connector 10, which is the holding connector. Specifically, the locking projections 45*a* of the connecting operating member 40 are fit into the first locking holes 15*a* of the bottom walls 15 of the connecting operating member holding portions 14. Thus, the insertion openings 47 of the operating grooves 46 are locked at positions matching the fitting grooves 13 of the receptacle 11.

Coupling of First and Second Members M1, M2

As described above, the first member M1 having the first wiring materials W1 wired and fixed to the first connector 10 and the second member M2 having the second wiring materials W2 and mounted with the second connector 20 are coupled to each other. Specifically, in this embodiment, the fit-in portion 2 having the cylindrical outer peripheral surface with a small diameter on the upper end of the first member M1 is fit into the tubular lower end part of the second member M2. Thus, the second member M2 is coupled to the first member M1 to be relatively rotatable about the rotation center axis equivalent to the center axes of the both members M1, M2.

At the time of this coupling, a relative angle (angle in a direction of the rotation) of the second member M2 with respect to the first member M1 is set such that the second connector 20 faces the first connector 10 in the connecting direction. In this embodiment, the relative angle of the second member M2 with respect to the first member M1 is determined such that the lower part of the connector housing 22 of the second connector 20 is fit lightly into the receptacle 11 of the connector housing 12 of the first connector 10 according to coupling in the direction along the center axes of the first and second members M1, M2, i.e. the first and second connectors 10, 20 are connected temporarily in the connecting direction parallel to a direction of the coupling as shown in FIGS. 3 and 4.

In this temporary connection, the operated portions 28 of the second connector 20 are projecting in the operating width direction from the side surfaces of the connector housing 22, but the operated portions 28 are fit into the fitting grooves 13 formed in the receptacle 11 and enter start end parts (left parts in FIG. 4) of the operating grooves 46 through the insertion openings 47 of the connecting operating member 40, as shown in FIG. 4. Thus, the operated portions 28 will not interfere with the receptacle 11 and the connecting operating member 40. In other words, the fitting grooves 13 and the insertion openings 47 enable the connector housing 20 to be fit temporarily into the receptacle 11 regardless of the operated portions 28 projecting from the connector housing 20.

Accordingly, in this embodiment, relative rotation of the second member M2 with respect to the first member M1 is disabled temporarily for temporary connection of the first and second connectors 10, 20 when the coupling of the first and second members M1, M2 is completed.

Connection of First and Second Connectors 10, 20 and Separation of Second Connector 20 from Connector Holding Member 30 by Operation of Connecting Operating Member 40

In the temporarily connected state, the connecting operating member 40 is operated further in the operating direction from the operation start position to the operation end position shown in FIG. 7 (direction indicated by the arrow Dp in FIG. 4). i.e. relatively moved in the operating direction with respect to the first connector 10. This simultaneously achieves complete connection of the first and second connectors 10, 20 (specifically, proper connection of the unillustrated connector terminals in the first connector 10 and the unillustrated connector terminals in the second connector 20) and the separation of the second connector 20 from the connector holding member 30.

Figure 5:
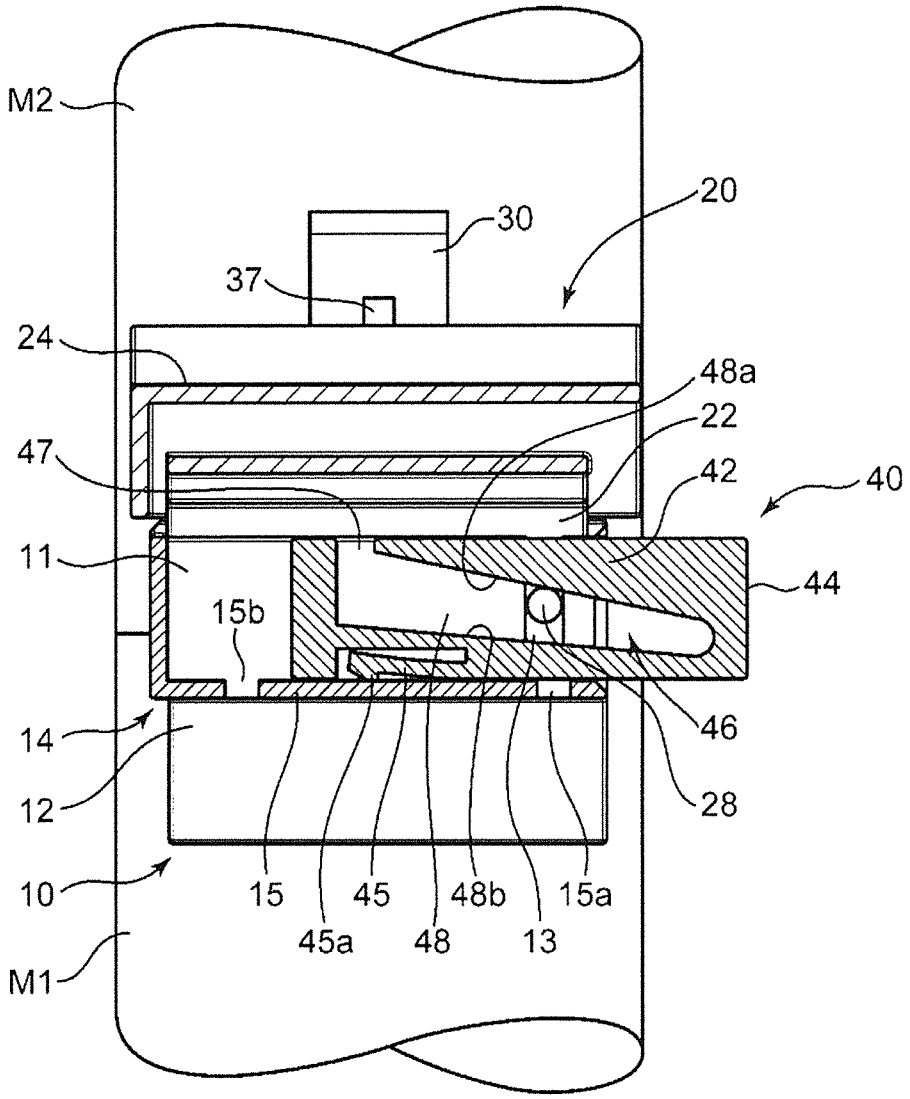
FIG. 5 is a front view in section showing a state where the connecting operating member is operated from the state shown in FIG. 4 to a position where the operating surfaces of the connecting operating member come into contact with the operated portions.

Specifically, while the connecting operating member 40 is moving from the connection start position to the connection end position, the upper end surfaces 48*a* of the operating grooves 46 of the connecting operating member 40, i.e. the operating surfaces inclined to be lowered according to a movement in the operating direction, obliquely come into contact with the operated portions 28 and the upper end surfaces 48*a* (operating surfaces) push down the operated portions 28 and eventually the entire second connector 2 including the operated portions 28 by the connecting operating member 40 being further operated from this state to the connection end position as shown in FIG. 5. By this push-down force, the locked projection 27 of the held portion 26 included in the second connector 20 and the locking hole 37 of the connector holding member 30 are disengaged to realize downward separation of the second connector 20 from the connector holding member 30 and complete connection of the first and second connectors 10, 20 in the vertical direction (connecting direction).

According to the device of this embodiment, both mutual connection of the first and second connectors 10, 20 and the separation of the second connector 20 from the connector holding member 30 are achieved by a simple operation of merely moving the connecting operating member 40 in the operating direction from the operation start position to the operation end position. The separation of the second connector 20 from the connector holding member 30 enables the second member M2 to rotate with respect to the first member M1 within the predetermined range (in this embodiment, within a range allowed by the extra lengths of the second wiring materials W2) despite the mutual connection of the first and second connectors 10, 20.

Further, the operated portions 28 are urged down by the contact of the operating surfaces (upper end surfaces 48*a* of the operating grooves 46) that are inclined with respect to the operating direction and the operated portions 28 in the device. Thus, there is an advantage that the connection of the first and second connectors 10, 20 and the separation of the second connector 20 from the connector holding member 30 can be achieved even if the positions of the operated portions 28 slightly vary in the coupling direction when coupling of the first and second members M1, M2 is completed.

Figure 8:
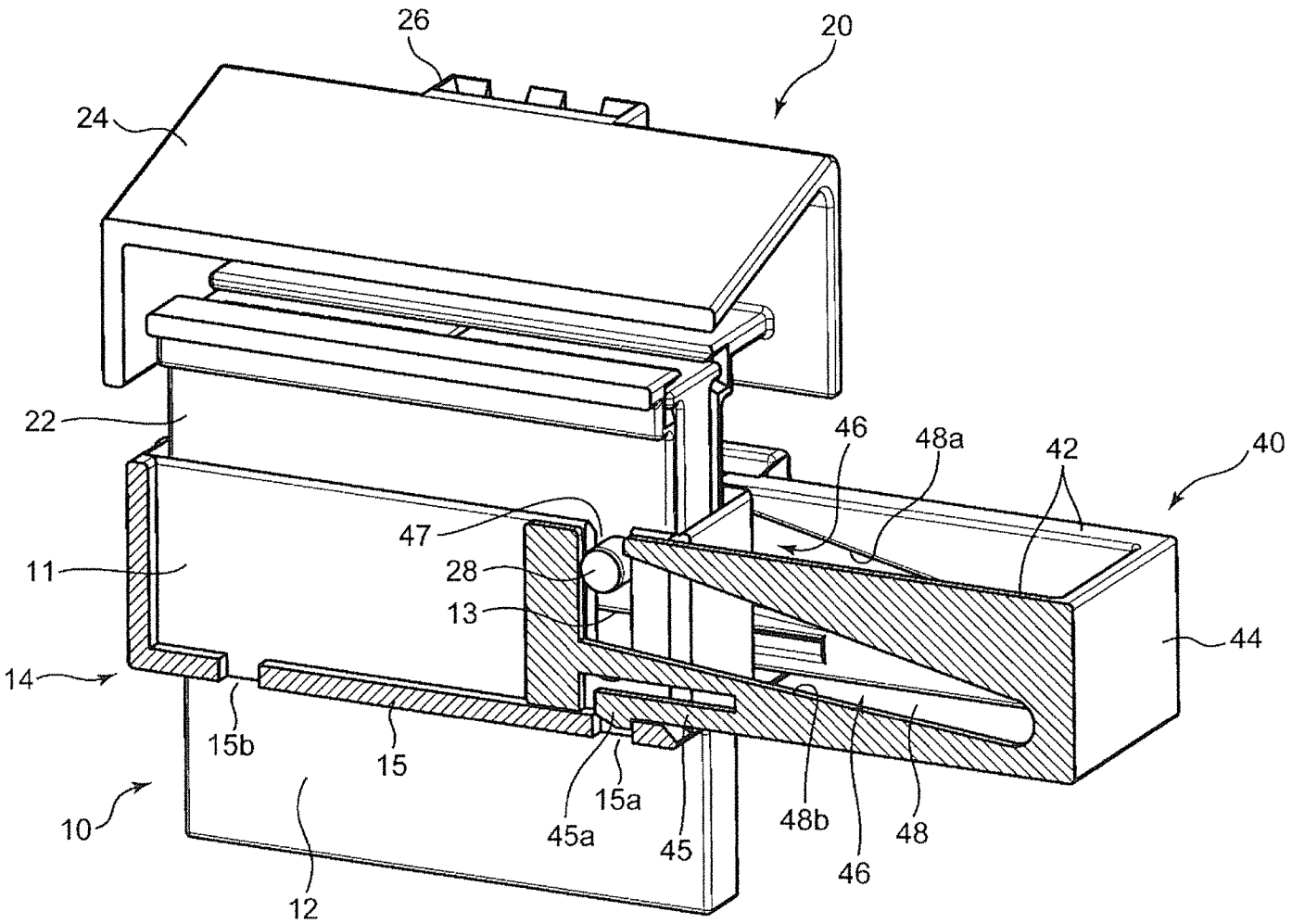
FIG. 8 is a perspective view partly in section showing a relative positional relationship of the operating surfaces of the connecting operating member and the operated portions of the second connector in a state, equivalent to the state shown in FIG. 4, where the operated portions are located at positions higher than those shown in FIG. 4.
Figure 9:
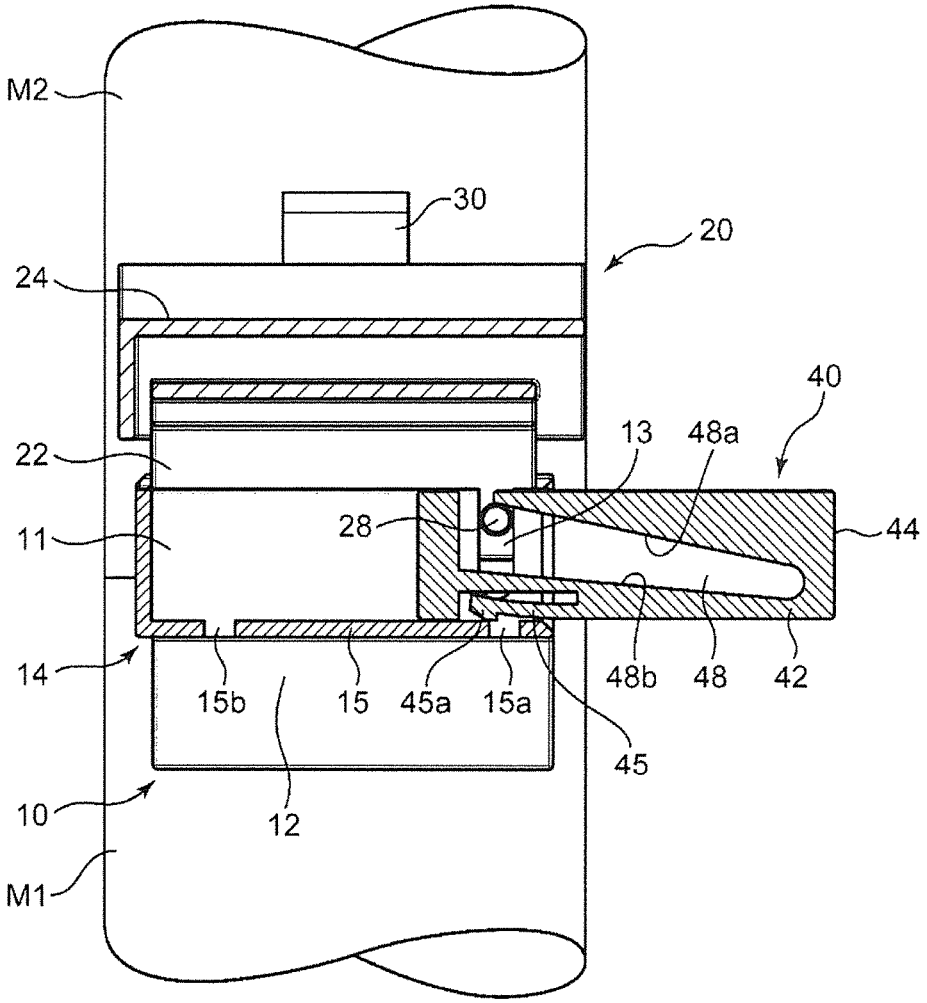
FIG. 9 is a front view in section showing a state where the connecting operating member is operated from the state shown in FIG. 8 to the position where the operating surfaces of the connecting operating member come into contact with the operated portions.

For example, even if the operated portions 28 are left at positions shown in FIG. 8, i.e. positions above the positions shown in FIG. 4 when the coupling of the first and second members M1, M2 is completed due to at least one of incomplete coupling of the first and second members M1, M2, an error in the mounting position of the first connector 10 on the first member M1, an error in the mounting position of the second connector 20 on the second member M2 and dimensional errors and assembling errors of other components, the connecting operating member 40 is operated in the operating direction from this state. Thus, the operating surfaces (upper end surfaces 48*a*) can move the operated portions 28 in the connecting direction by coming into contact with the operated portions 28 and being further operated from that position at a timing (timing earlier than that shown in FIG. 4) corresponding to the positions of the operated portions 28. In other words, positional variation of the operated portions 28 in the connecting direction can be absorbed by a deviation of contact timing of the upper end surfaces 48*a* with the operated portions 28. In this way, the connection of the first and second connectors 10, 20 and the separation of the second connector 20 from the connector holding member 30 can be achieved.

As described above, an electrical connection device is provided for efficiently electrically connecting members to be coupled to each other to be rotatable relative to one another.

More particularly, an electrical connection device for establishing electrical connection between a first wiring material wired in a first member and a second wiring material wired in a second member to be coupled to the first member in a coupling direction along a predetermined rotation center axis and to be relatively rotatable about the rotation center axis. The electrical connection device includes a first connector to be connected to the first wiring material and fixed to the first member, and a second connector to be connected to the second wiring material and mounted on the first member and configured to form the electrical connection by being connected to the first connector in a specific connecting direction. A connector holding member is linked to the second member and is configured to hold the second connector at a position where the first and second connectors are capable of facing each other in the connecting direction with the first and second members coupled and holds the second connector in such a manner as to allow the second connector to be separated from the connector holding member in the connecting direction upon application of an external force to the second connector in the connecting direction. A connecting operating member is to be held in a holding connector selected from the first and second connectors relatively movably in an operating direction intersecting the connecting direction. The connecting operating member includes a connector operating portion configured to connect the first and second connectors to each other by pulling an operated connector on a side opposite to the holding connector, out of the first and second connectors, toward the holding connector along the connecting direction and separate the second connector from the connector holding member in the connecting direction by being relatively moved in the operating direction with respect to the holding connector in a state where the first and second members are coupled and the first and second connectors are facing each other in the connecting direction.

Here, that "the first and second connectors are facing each other in the connecting direction" means both a state where the first and second connectors are facing, each other at a distance in the connecting direction and a state where the first and second connectors are in a temporarily connected state to partially overlap each other in the connecting direction.

According to this electrical connection device, connection of the first and second members and the separation of the second connector from the connector holding member can be performed simultaneously performed by a simple operation of merely moving the connecting operating member held in the holding connector, which is either one of the connectors, in the operating direction intersecting the connecting direction with respect to the holding connector in the state where the first and second members are coupled to each other in the coupling direction and the first and second connectors are facing each other in the connecting direction. That is, the simple operation of the connecting operating member can simultaneously establish electrical connection by connecting the first and second connectors to each other and allow mutual relative rotation of the first and second members by separating the second connector from the connector holding member.

The connecting direction may be parallel to the rotation center axis. This facilitates an operation of aligning the first and second connectors, i.e. an operation of causing the connectors to face each other in the connecting direction when the first and second members are coupled.

The operated connector may include an operated portion to be operated by the connector operating portion. The connector operating portion may have an operating surface inclined with respect to the operating direction to come into contact with the operated portion and pull the operated portion toward the holding connector as the connecting operating member is moved in the operating direction with respect to the holding connector.

This operating surface can come into contact with the operated portion and pull the operating direction in the connecting direction even if there is a slight error in the position of the operated portion due to a dimensional error of each part, incomplete connection of the first and second members and the like. That is, the operating surface can realize mutual connection of the first and second connectors and the separation of the second connector from the connector holding member by absorbing positional variation of the operating direction.

The holding connector may be either one of the first and second connectors, but the first connector to be fixed to the first member is preferably the holding connector, i.e. a connector for holding the connecting operating member to allow a relative movement of the connecting operating member in the operating direction. This can make an actual movement of the connecting operating member a simple movement in a direction matching the operating direction and, thereby, can make the operation of the connecting operating member easier as compared to the case where the second connector, which has to be separated from the connector holding member, is the holding connector.

The invention is not limited to the embodiment described above. The present invention includes, for example, the following embodiments.

Concerning Connecting Direction

The connecting direction of the first and second connectors is not limited to the direction parallel to the rotation center axis of the first and second members. For example, the connecting direction may be set to be a direction along the direction of relative rotation of the first and second members (e.g. direction tangent to the outer peripheral surfaces of the first and second members M1, M2 or a direction close to the former direction in the above embodiment). However, since a distance between the first and second connectors in the connecting direction is largely changed by relative rotation of the second member with respect to the first member in this case, position alignment is difficult. In contrast, it is advantageous in facilitating an operation of aligning the first and second connectors, i.e. causing the both connectors to face each other in the connecting direction when the first and second members are coupled that the connecting direction of the first and second connectors is a direction parallel to the rotation center axis as in the above embodiment.

Concerning Operating Direction

The operating direction of the connecting operating member only has to be a direction intersecting the connecting direction and may not necessarily be a direction perpendicular to the connecting direction. However, as a component in the connecting direction included in the operating direction becomes smaller, a function of a force multiplying mechanism for reducing an operating force required for connection increases.

Concerning Holding Connector and Operated Connector

In the above embodiment, the first connector 10 is the holding connector for holding the connecting operating member 40 and the second connector 20 is the operated connector to be operated by the connecting, operating member 40. However, conversely, a second connector may be a holding connector for holding a connecting operating member, and a first connector may be an operated connector to be operated by the connecting operating member. However, in this case, an actual movement or the connecting operating member is a complex movement including not only a relative movement in an operating direction with respect to the second connector, but also a movement of the second connector in a connecting direction toward the second connector (i.e. separating movement of the second connector from a connector holding member in a separating direction), wherefore the operation of the connecting operating member becomes complicated. In contrast, if the first connector to be fixed to the first member is the holding connector, an actual movement of the connecting operating member is a simple movement including only a movement in the operating direction. Thus, the operation of the connecting operating member is advantageously facilitated.

The invention claimed is:

1. An electrical connection device for establishing electrical connection between a first wiring material wired in a first member and a second wiring material wired in a second member that is to be coupled to the first member in a coupling direction along a predetermined rotation center axis to be relatively rotatable about the rotation center axis, comprising:

a first connector connected to the first wiring material and fixed to the first member;

a second connector connected to the second wiring material and mounted on the second member and configured to form the electrical connection by being connected to the first connector in a specific connecting direction, one of the first and second connectors defining a holding connector and the other of the first and second connectors defining an operated connector;

a connector holding member linked to the second member and configured to hold the second connector at a position where the first and second connectors face each other in the connecting direction with the first and second members coupled, the connector holding member further being configured to allow the second connector separated from the connector holding member in the connecting direction upon application of an external force to the second connector in the connecting direction; and a connecting operating member held in the holding connector selected from the first and second connectors and being relatively movably in an operating direction intersecting the connecting direction, the connecting operating member including a connector operating portion configured to connect the first and second connectors to each other by pulling the operated connector toward the holding connector along the connecting direction and to separate the second connector from the connector holding member in the connecting direction by being moved in the operating direction with respect to the holding connector in a state where the first and second members are coupled and the first and second connectors are facing each other in the connecting direction.

2. The electrical connection device of claim 1, wherein the connecting direction is a direction parallel to the rotation center axis.

3. The electrical connection device of claim 2, wherein the operated connector includes an operated portion to be operated by the connector operating portion, and the connector operating portion has an operating surface inclined with respect to the operating direction to come into contact with the operated portion and pull the operated portion toward the holding connector as the connecting operating member is relatively moved in the operating direction with respect to the holding connector.

4. The electrical connection device of claim 3, wherein the holding connector is the first connector and the operated connector is the second connector.

5. The electrical connection device of claim 1, wherein the holding connector is the first connector and the operated connector is the second connector.

* * * * *